United States Patent [19]

Shacket et al.

[11] Patent Number: 4,744,182

[45] Date of Patent: May 17, 1988

[54] MODULAR BUILDING STRUCTURE AND METHOD

[75] Inventors: Sheldon Shacket, Southfield; Robert Helfman, Franklin, both of Mich.

[73] Assignee: Trus-Us, Inc., Royal Oak, Mich.

[21] Appl. No.: 470,276

[22] Filed: Feb. 28, 1983

[51] Int. Cl.[4] ..... E04H 1/00

[52] U.S. Cl. ..... 52/79.8; 52/79.1; 52/143; 52/236.4

[58] Field of Search ..... 52/79.7, 79.8, 79.1, 52/79.9, 224, 236.3, 236.4, 143, 126.1

[56] References Cited

U.S. PATENT DOCUMENTS

| | | | |
|---|---|---|---|
| 2,154,142 | 4/1939 | Whelan . | |
| 3,292,327 | 12/1966 | Van Der Lehy . | |
| 3,629,983 | 12/1971 | Jenn . | |
| 3,664,082 | 5/1972 | Zintel | 52/126.1 |
| 3,810,335 | 5/1974 | McCrillis et al. | 52/79.1 |
| 3,834,110 | 9/1974 | Vercelletto | 52/79.7 |
| 3,852,924 | 12/1974 | Levenson . | |
| 4,021,976 | 5/1977 | Colma | 52/79.7 |
| 4,102,091 | 7/1978 | Farge | 52/79.7 |
| 4,125,975 | 11/1978 | Soble | 52/126.1 |
| 4,250,669 | 2/1981 | Freeauf | 52/79.8 |

FOREIGN PATENT DOCUMENTS

| | | | |
|---|---|---|---|
| 2309960 | 3/1972 | Fed. Rep. of Germany | 52/234 |
| 2514623 | 10/1976 | Fed. Rep. of Germany | 52/126.1 |
| 1340766 | 9/1963 | France | 52/79.8 |
| 600838 | 12/1959 | Italy | 52/234 |

OTHER PUBLICATIONS

"Glider", A New Glider Caracoach for 52, 8/22/52, Two pages (2) of advertisement.

*Primary Examiner*—John E. Murtagh
*Assistant Examiner*—Andrew J. Rudy
*Attorney, Agent, or Firm*—Dale R. Small

[57] ABSTRACT

A building structure comprising a core unit including bathroom and kitchen facilities and a plurality of entrance and exit openings and a plurality of other separate building units having entrance and exit openings therein positioned adjacent the core unit and in communication therewith and with each other through aligned entrance and exit openings, separately constructed at a remote location and secured together in vertically adjusted level position at the building site. The invention further includes the method of constructing the building structure including the steps of constructing the separate core and other building units at a remote location, transporting them to a building site, locating them on foundation structures, vertically adjusting the individual structures and securing them together and subsequently adding additional other separate building units to expand the building structure.

13 Claims, 5 Drawing Sheets

KITCHEN
DINING
BATHROOM
BEDROOM
LIVING/BED ROOM

FIG. 4
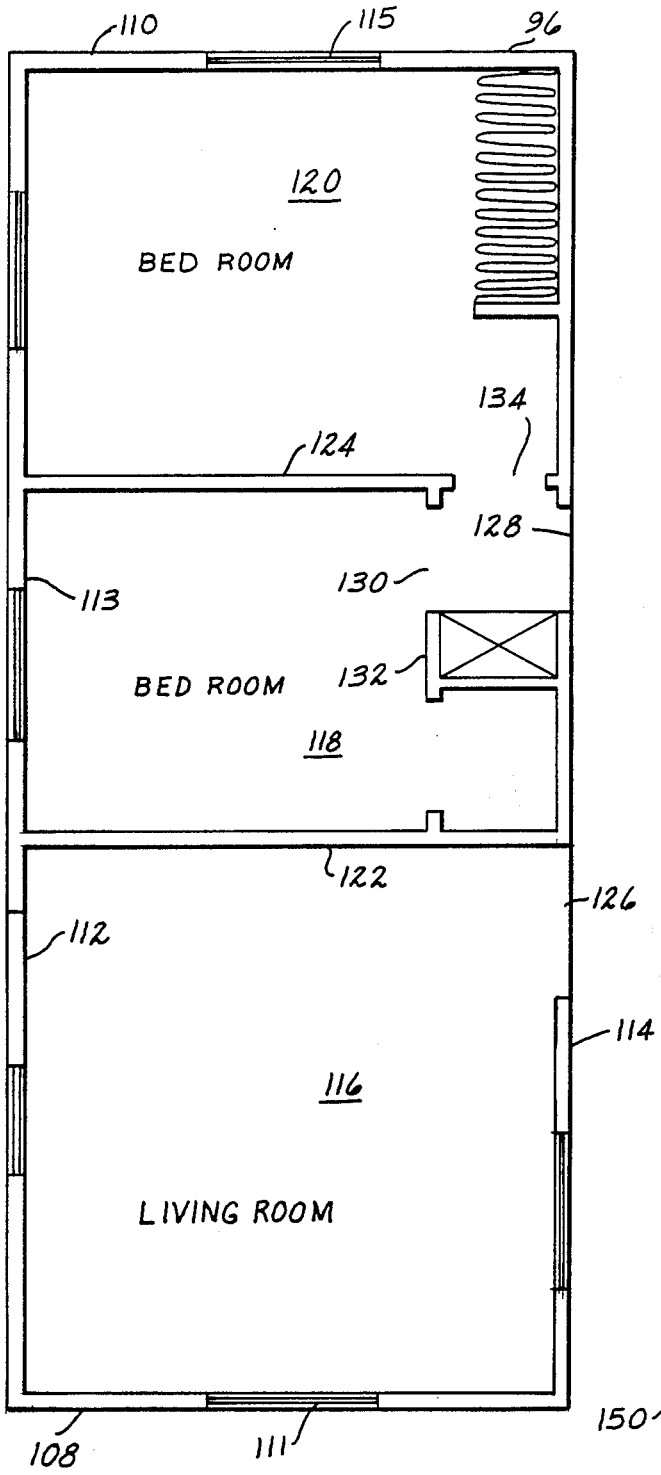
FIG. 5
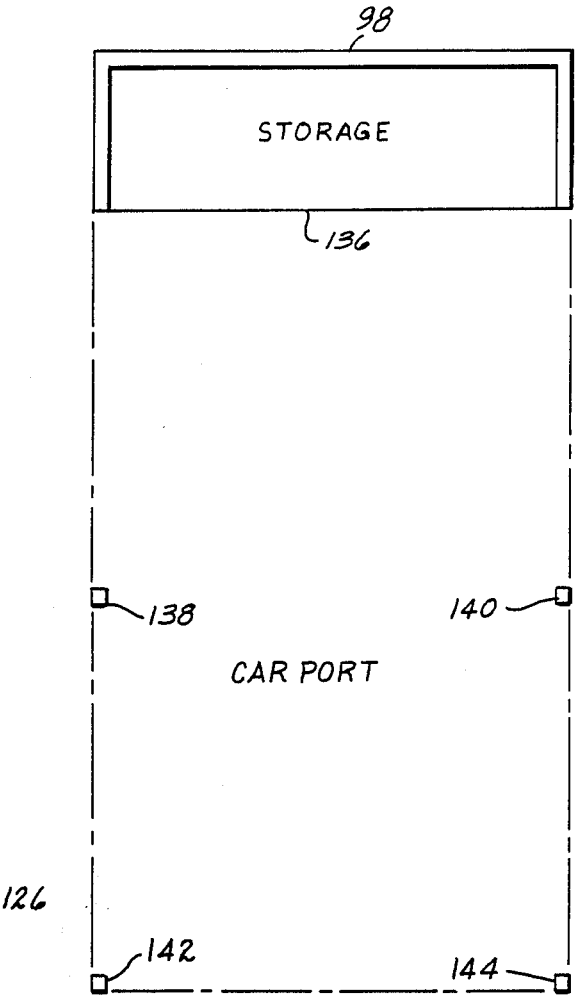
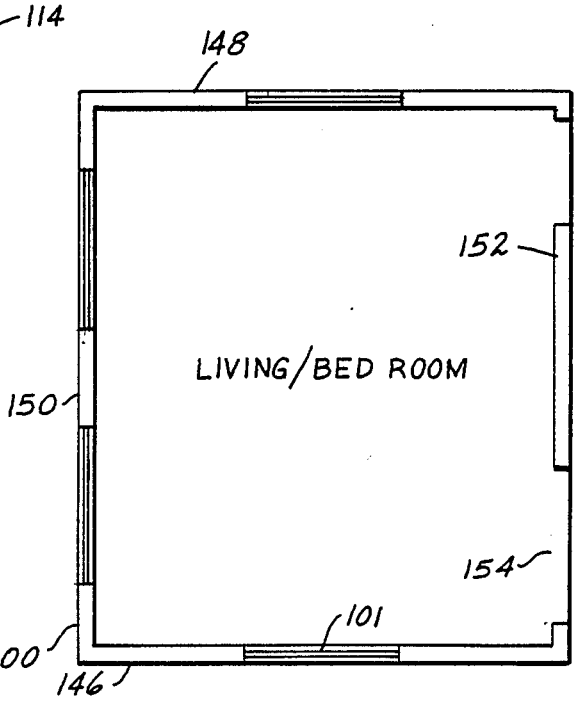
FIG. 6

FIG. 10
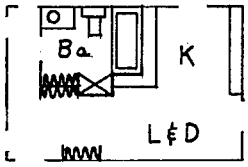
FIG. 11
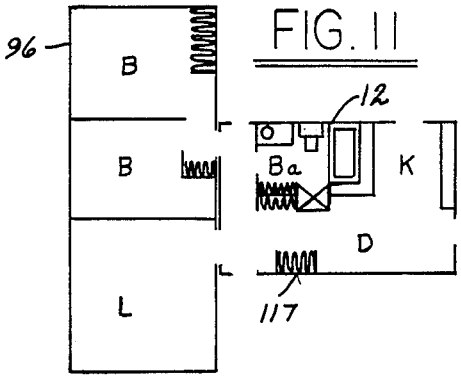
FIG. 12
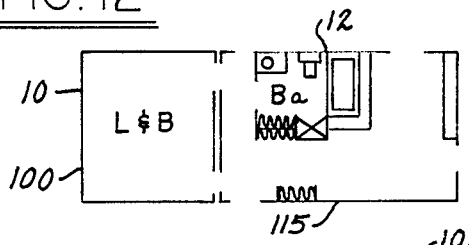
FIG. 13
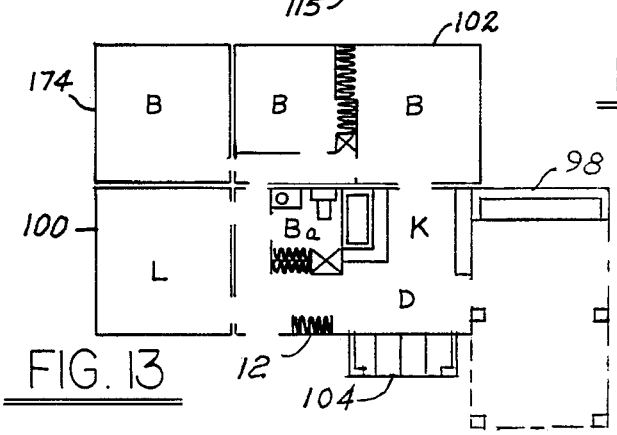
FIG. 14
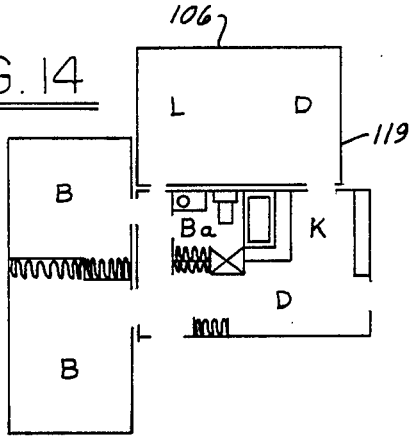
FIG. 15
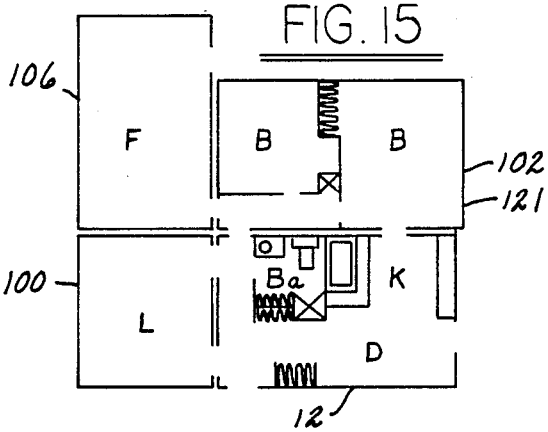
FIG. 16
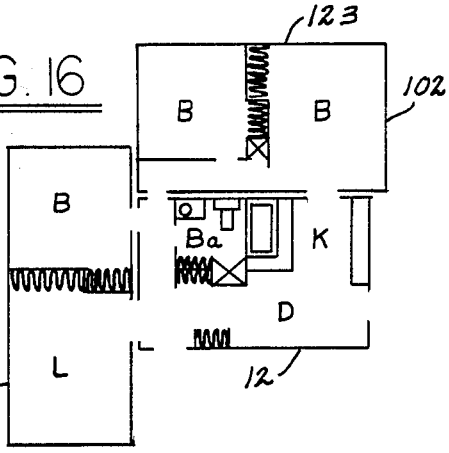
FIG. 17
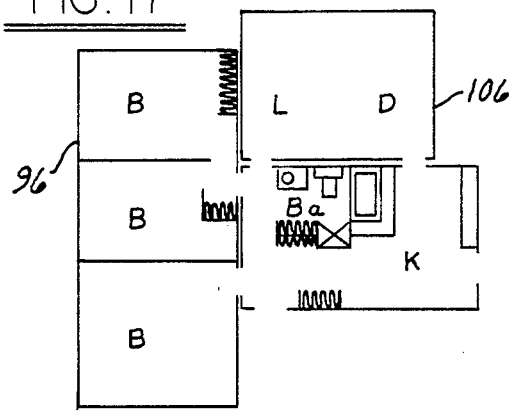
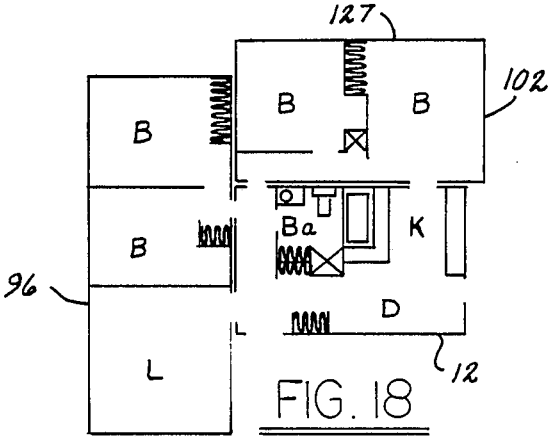
FIG. 18

MODULAR BUILDING STRUCTURE AND METHOD

BACKGROUND OF THE INVENTION

1. Field of the Invention

The invention relates to modular building structures and methods and refers more specifically to a building structure including a core unit having bathroom and kitchen facilities and a plurality of other building units positioned adjacent and connected to the core unit allowing free traffic flow between the core unit and other building units and other building units through the core unit which building structure is constructed by manufacturing the core unit and other building units at a remote location shipping the building units to a building site, placing them in desired relationship leveling them and securing them together and subsequently adding additional building units to increase the size of the building structure.

2. Description of the Prior Art

In the past, building structures such as houses and the like, have usually been built at the building site that is to say, houses generally are built from the ground up at the location of the house.

More recently, mobile homes and small buildings have been manufactured in factories remote from a site at which they are to be used and have been transported to the site. In some instances, two or more mobile homes or the like have been secured together at the site to produce a larger building structure.

Such structures of the past however, have lacked flexability. That is to say, such structures have not readily lent themselves to providing efficient home floor plans and/or connection of a plurality of separate units together. Further, such structures of the past have not readily permitted subsequent additions thereto after the initial structure has been built and the design of the prior structures has not been esthetically pleasing. Further, such structures have in the past often been complicated, expensive and inefficient.

SUMMARY OF THE INVENTION

The structure of the invention comprises a house constructed of a plurality of separate units including a core unit having bathroom and kitchen facilities therein and other building units connected thereto and therethrough, through aligned openings therein. The roof lines of the separate building units are varied to facilitate connection of the individual building units and each separate building units includes leveling structure to adjust the vertical height thereof and facilitate connection of the various building units.

In accordance with the invention, a single core unit may be readily expanded in steps to provide an efficiency unit up to at least a four bedroom house in stages as a larger house is required. Also, the house of the invention is capable of being reduced in size as the necessity for a larger house is reduced.

In accordance with the method of the invention, all of the building units including the core unit and the other building units are produced at a location remote from a building site, the separate units are then transported to the building site, set in a desired position on the building site, leveled and secured together to provide a house on a building site in a minimum of time with a minimum of disturbance to the area surrounding the building site. It is contemplated that the building units will be trucked to a building site and placed in position on a prepared foundation by means of a crane or the like, leveled and secured together in a minimum amount of time.

BRIEF DESCRIPTION OF THE DRAWINGS

FIG. 4 is a floor plan of another building unit of the building structure of the invention including a living room bedroom area, and two separate bedroom areas.

FIG. 5 is a plan view of storage and carport structure of the building structure of the invention.

FIG. 6 is a plan view of another building unit for the building structure of the invention including a living room, bedroom area.

FIGS. 10 through 17 are reduced floor plans of building structures constructed in accordance with the invention utilizing the building units illustrated in FIGS. 2 and 4 through 9 in various combinations.

DESCRIPTION OF THE PREFERRED EMBODIMENT

Figure 1:
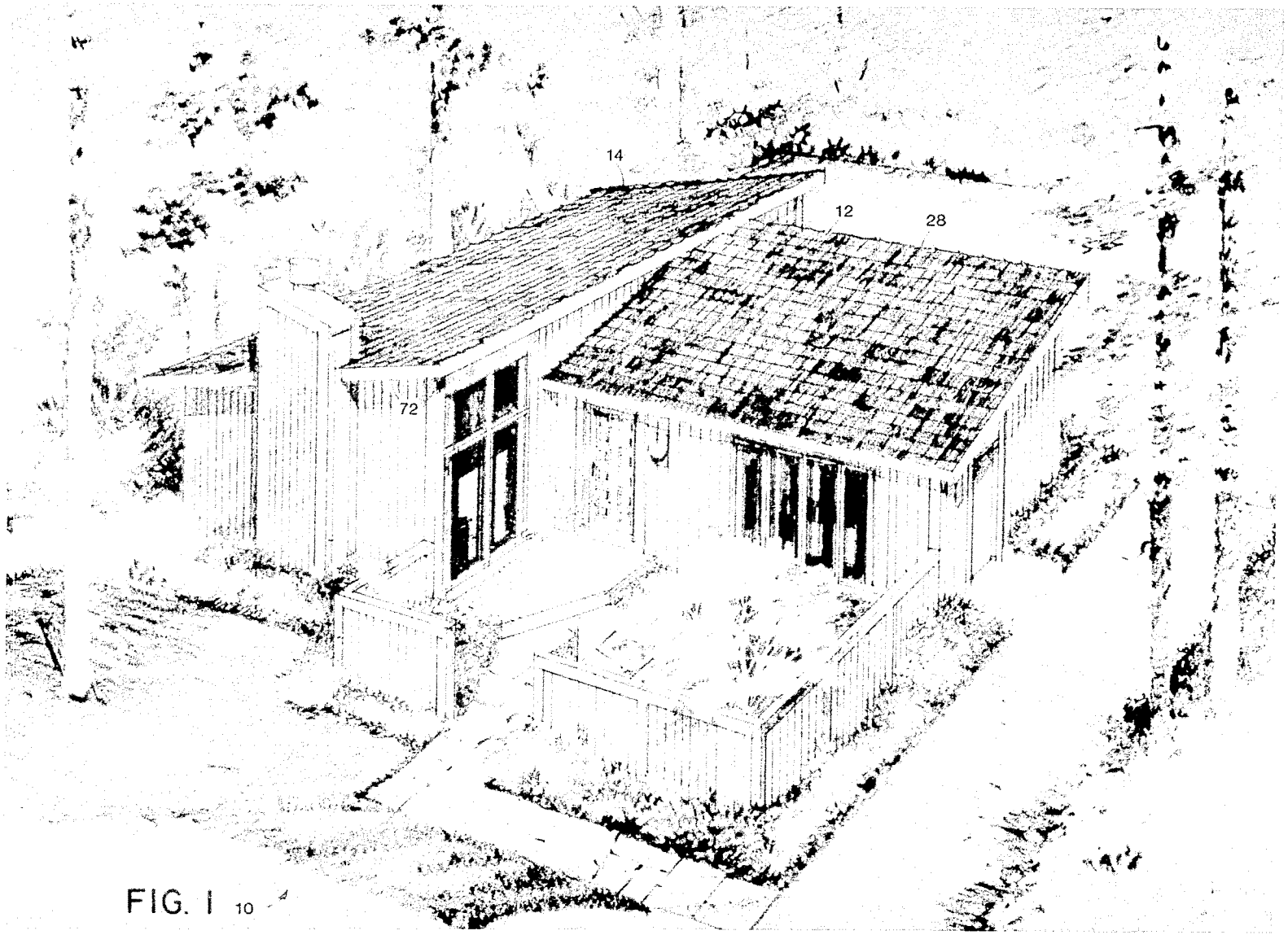
FIG. 1 is a perspective view of building structure constructed in accordance with the method of the invention.
Figures 2, 3:
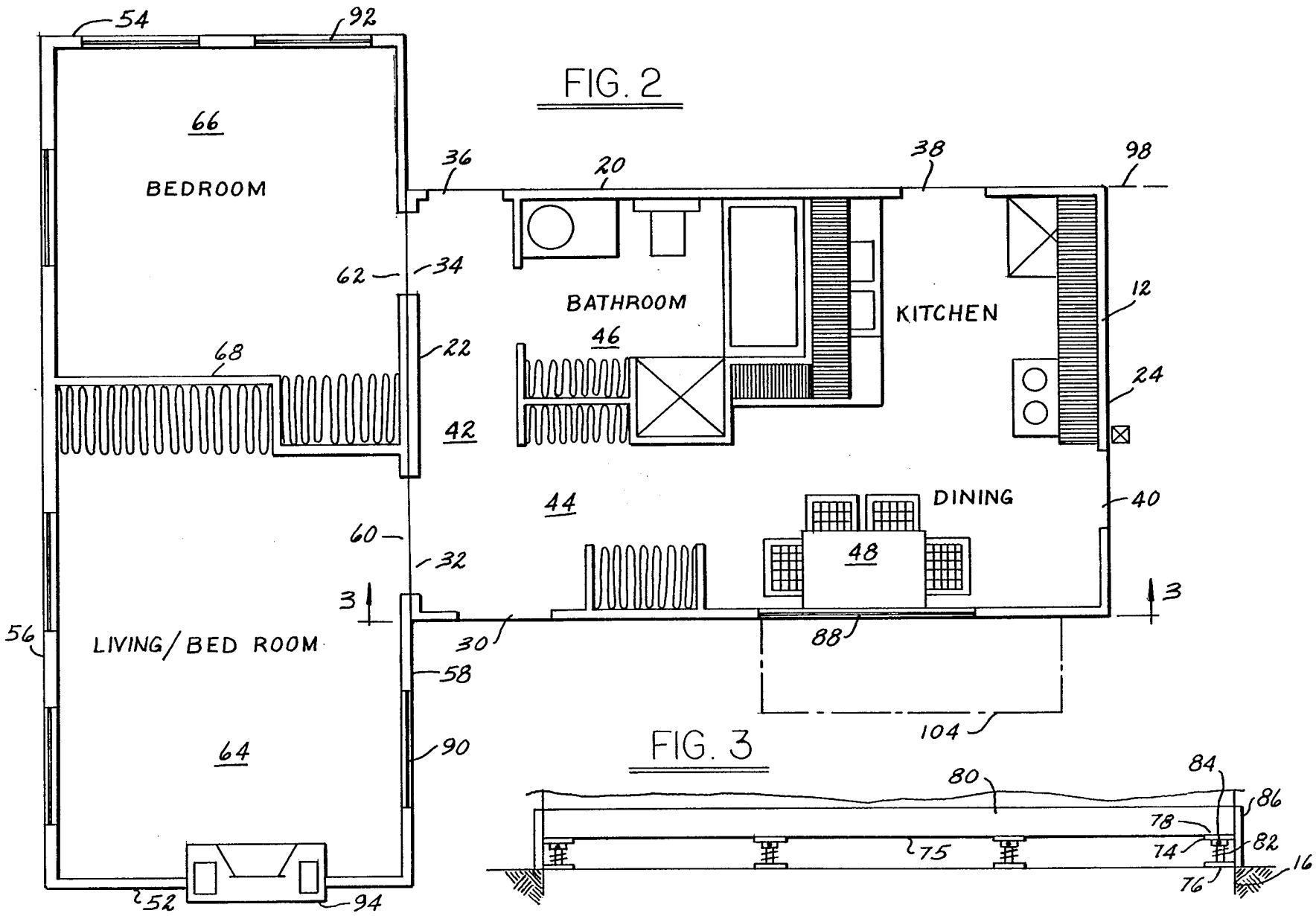
FIG. 2 is a floor plan of the building structure illustrated in FIG. 1.
FIG. 3 is a partial section view of the building structure illustrated in FIG. 2 taken substantially on the line 3—3 in FIG. 2.

The building structure 10 illustrated in FIG. 1 is constructed of a core unit 12 and another building unit 14 positioned on foundation structure 16 leveled and secured together to form a one bedroom house 10 as shown in FIG. 1 having the floor plan shown in FIG. 2.

In accordance with the method of the invention the core unit 12 and the other building unit 14 are completely constructed at a remote location and are shipped to a building site as shown in FIG. 1. The building units 12 and 14 are then positioned as shown in FIG. 1 leveled and secured together to form a basic house having a single bedroom. Subsequently, other building units may be manufactured at a remote location shipped to the site and secured to the existing building units 12 and 14 to increase the size of the house in accordance with the method of the invention.

More specifically, as shown best in FIG. 2, the core unit 12 includes a front wall 18, a back wall 20, a first end wall 22 and a second end wall 24. Core unit 12 additionally includes a floor structure 26 and a roof structure 28. The core unit 12 is generally rectangular as shown and has an inclined roof substantially as shown in FIG. 1. The core unit 12 includes entry and exit openings 30,32,34,36,38, and 40 in the front wall 18, first end wall 22, back wall 20 and the second end wall 24 as shown through which traffic flow into and out of the core unit 12 is facilitated.

Core unit 12 includes the hall area 42 extending between the openings 30 and 36 as shown in FIG. 2. In addition, an entry area 44 is provided adjacent the front wall 18 at the first end wall 22 and a bathroom 46 is provided adjacent the back wall 20 and first end wall 22 off the hall 42. An eating area 48 and kitchen area 50 are provided adjacent the second end wall 24 and adjacent the front wall 18 and back wall 20 respectively.

Thus, the major home facilities are concentrated in the core unit 12. Further, easy flow and traffic patterns to all attached other building units through the openings 30,32,34,36,38, and 40 is provided through the core unit 12.

The other building unit 14 illustrated in FIGS. 1 and 2 includes a front wall 52, back wall 54, first end wall 56, and second end wall 58. Entry and exit openings 60 and 62 are provided in the second end wall 58 as shown. The generally rectangular space defined between the front and back walls 52 and 54 and the end walls 56 and 58 is divided into a living room, bedroom area 66 by the closet partition 68.

The other building unit 14 is completed by a floor structure 70 and a roof structure 72. As will be seen best in FIG. 1, the roof structure 72 is inclined and is at a higher elevation than the roof 28. The securing of the core unit 12 and other building unit 14 together is thus facilitated since joining of the two roof lines is not required. It will of course be necessary to flash and otherwise waterproof the area where the roof structure 28 intersects the end wall 58 of the other building unit 14.

Each of the core unit 12 and the other building unit 14 is provided with a plurality of leveling structures such as leveling structures 74, shown best in FIG. 3, positioned beneath the floor structure 70 thereof. Leveling structure 74 is essentially a screw type jack including the base 76, the plate 78 positioned respectively on the foundation structure 16 and the floor joists 80 as required to distribute the load from the building units into the foundation structure and a nut and screw structure 82 operable therebetween which on being turned by a suitable handle not shown inserted for example in openings 84 in the screw type member 82 will cause the base and plate 76 and 78 to separate.

In the method of constructing the building structure 10, in accordance with the invention, the core unit 12 is completely manufactured to include all desired utilities and connections therefor at a location remote from the building site as shown in FIG. 1. Similarly, the other building unit 14 is completely constructed at a remote location to include utility connections thereto. The separate building units 12 and 14 are then transported to the building site as shown in FIG. 11 as by truck or the like and are positioned on a prepared foundation as for example a concrete slab 16 or separate abutments and are leveled and height adjusted by the adjusting structure 74.

Building units 12 and 14 are then secured together by convenient means such as bolts or the like extending through the first end wall 22 of the core unit 12 and the second end wall 58 of the other building unit 14. The space between the building units 12 and 14 and the foundation structure 16 may then be closed by means of appropriate skirt members 86 or the like.

Flashing and waterproofing at the connected walls 22 and 58 is then accomplished as required to provide the basic floor plan for the house 10 shown in FIG. 2.

It will be noted in FIG. 2, that the openings 32 and 34 provide entrance and exit to and from the areas 64 and 68 of the building unit 14 through the openings 60 and 62 in the core unit 14 aligned therewith. The entrance and exit openings 30,36,38, and 40 are provided with doors or if desired may be permanently closed with wall structure to be opened only if additional building structure 10.

As shown, the building units 12 and 14 may have window structures 88,90 and 92 therein where desired as well as chimney structure 94 as shown best in FIG. 1.

In accordance with the invention, other separate building units 96,98,100,102,104 and 106 may be variously combined with the core unit 12 and in some cases also with the core unit 14 and each other to provide a variety of building structure floor plans and house sizes. Each of the separate building unit structures 96,98,100,102,104 and 106 may be constructed at a remote location and transported to a building site as shown in FIG. 1 and variously connected to the core unit 12 and/or each other as desired.

More specifically, the building unit 96 includes a front wall 108, a back wall 110, a first end wall 112, and a second end wall 114. The rectangular spaced defined by the front wall 108, rear wall 110, and end walls 112 and 114 is divided into a living room, bedroom area 116, a bedroom area 118 and a bedroom area 120 by interior partitions 122 and 124. Entrance and exit opening 126 and 128 are provided in the second end wall 114 as shown. Thus, opening 126 in wall 114 is positioned adjacent the interior partition 122 and permits entrance into the living room, bedroom area 116. Opening 128 permits entry into either the bedroom area 118, or the bedroom area 120 through opening 130 in partitions 122 and 124 and the opening 134 in the partition wall 124 adjacent the wall 114 respectively.

The building unit 96 includes a floor structure 136 and is provided with a roof structure not shown similar to that of the roof structure 72. Windows 11,113 and 115 may be provided as desired.

Thus, it will be noted that by aligning the openings 126 and 128 with for example the openings 32 and 34 in the wall 22 of the core unit 12 with the building unit 96 being substituted for the building unit 14 a two bedroom house is provided which will be very similar in external appearance to the one bedroom house illustrated in FIG. 1.

Either the one bedroom or two bedroom house considered above, could also include the carport, storage structure 98 shown in FIG. 5. In combination with for example the one bedroom home illustrated in FIGS. 1 and 2, the storage structure 138 could extend outwardly from the second end wall 28 as an extension of the wall 20 and a lower roof structure not shown which is adapted to fit beneath the roof structure 28 could be supported on the storage structure 98 and carport posts 138,140,142, and 144. Such attachment of the carport, storage building unit 98 is suggested in phantom in FIG. 2.

Figure 8:
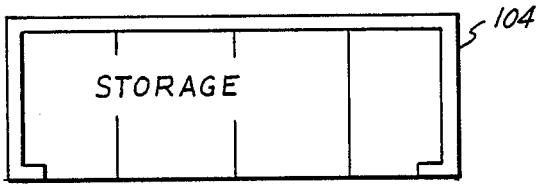
FIG. 8 is a plan view of a storage unit of the building structure of the invention.
Figure 9:
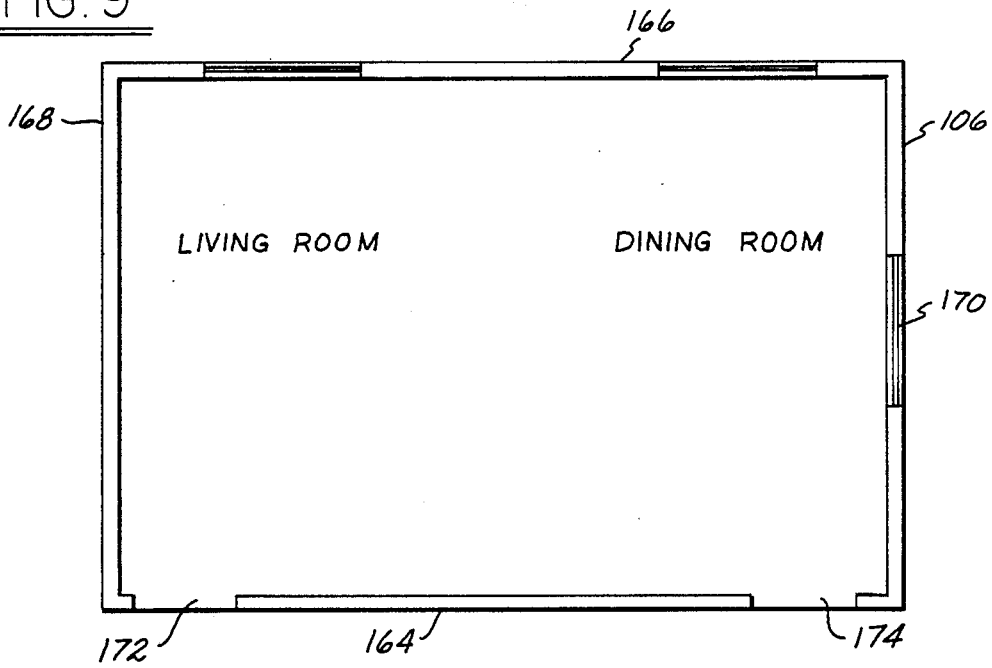
FIG. 9 is a floor plan of another building unit of the building structure of the invention including living and dining areas.

Similarly, a separate storage unit 104 as shown in FIG. 8 may be manufactured at a remote location and shipped to the building site as shown in FIG. 1 and secured to the core unit 12 in front of an beneath the windows 88 if desired as shown in phantom in FIG. 2. Again, the separate storage unit 104 can be utilized with any of the building structures contemplated by various assemblages of the core unit 12 and the other building units 14,96,98,100,102, and 106.

A building unit 100 such as shown in FIG. 6 when combined with a core unit 12 as shown in FIG. 2, in place of the building unit 14 provides an efficiency living unit as shown in FIG. 10 having a combined living room bedroom area in the building unit 100. As shown, the building unit 100 has the front wall 146, backwall 148, first end wall 150, and second end wall 152. Second end wall 152 has the entry and exit opening 154 therein adjacent the front wall 146 as shown best in FIG. 6. Windows 101 again may be provided as desired in the building unit 100.

Figure 7:
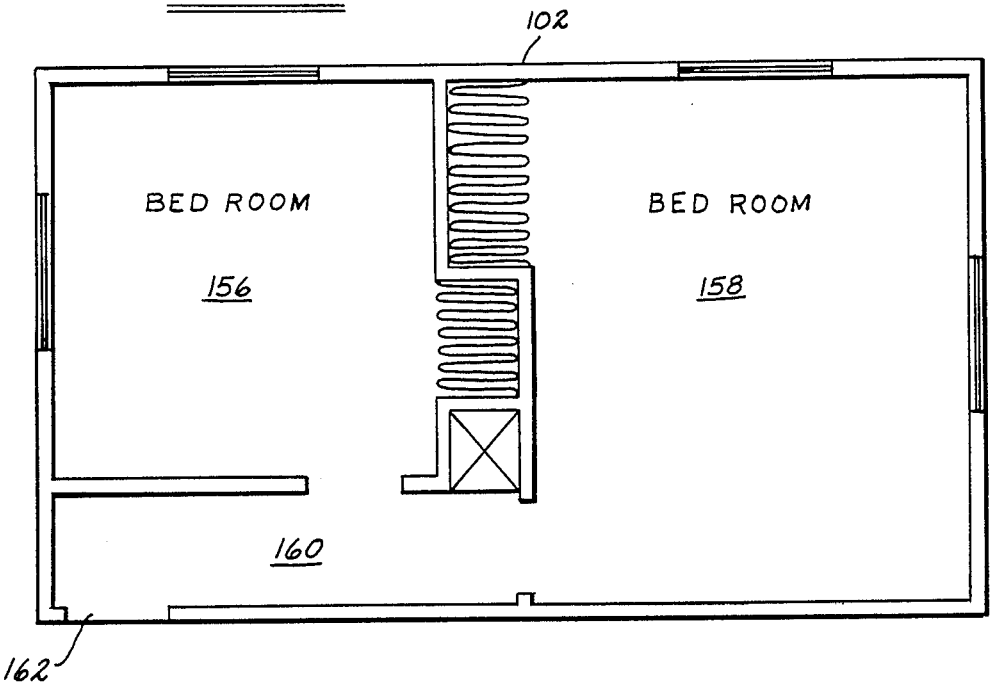
FIG. 7 is a floor plan of another building unit of the building structure of the invention including two separate bedroom areas.

Further, as shown in FIG. 7, a building unit 102 having two bedroom areas 156 and 158 and a hall area 160 therein may be provided in combination with for example the one bedroom home illustrated in FIG. 2 so that the entrance and exit openings 36 is aligned with the entry and exit opening 162 and with the entry and exit opening 38 closed so that the one bedroom home of FIG. 2 may be subsequently changed into a three bedroom home as shown for example in FIG. 15.

Similarly, the one bedroom home in FIG. 2 may be changed into a two bedroom home with a living and dining area as shown in FIG. 13 by subsequently obtaining a building unit such as the building unit 106 having a living and dining area and attaching it to the two bedroom home illustrated in FIGS. 1 and 2.

Building unit 106 as shown includes the front wall 164, the back wall 166, the first end wall 168, and the second end wall 170. Entrance and exit openings 172 and 174 are provided in the building unit 106 and with the unit 106 in assembly with the one bedroom home of FIGS. 1 and 2, would be aligned with the entry and exit openings 36 and 38 respectively.

Thus, the separate building units as shown particularly in FIGS. 2 and 4 through 9, may be utilized in various combinations with the core unit 12 having the entrance and exit openings shown and with the particular floor plan shown to provide a plurality of building structures, that is, houses having varied floor plans and of various sizes including an efficiency unit through at least a four bedroom house as illustrated for example in FIG. 17. Thus, in FIG. 10, the basic efficiency unit 115 including the building unit 100 and the core unit 12 is shown.

FIG. 11 shows a basic two bedroom home 117 including the core unit 12 and the building unit 96. FIG. 12 teaches a core unit 12, another building unit 102, a building unit 100, and a separate building unit 174 similar to the building unit 100 which is slightly smaller than the building unit 100. The unit 12 is of course a three bedroom house.

As previously indicated, the house 119 shown in FIG. 13 is a two bedroom unit having a separate living and dining area while the building structure 121 of FIG. 14 is another three bedroom home having a separate living dining area including the core unit 12, a building unit 100, a building unit 106, and a building unit 102.

Again, the building structure 123 of FIG. 15 is a three bedroom home having a separate living area formed from the securing together of a basic core unit 12, a building unit 14, and a building unit 102.

The building structure 125 of FIG. 16 includes a core unit 12, a separate building unit 96 and a building unit 106 connected together as shown and the building structure 127 of FIG. 17 is a four bedroom unit including the core unit 12, the building unit 96, and the building unit 102.

As illustrated in conjunction with the building units 12 and 14 of FIGS. 1 and 2, the roof lines of the other building units such as building units 102,106,96 and 148 may be provided at different levels and have different slopes so as not to intersect. Thus, in the connecting of the separate building units with the core unit, connecting of intersecting roof lines is not required.

While one embodiment of the present invention has been considered in detail together with modifications thereof, it will be understood that other embodiments and modifications of the modular building structure of the invention are contemplated by the inventor. Thus, the building units shown may be combined in further more complex building structures or houses and other building units may be provided to increase the flexability of the homes constructed around the central core unit by the building units . It is the intention to include all such modifications and embodiments as are defined by the appended claims within the scope of the invention.

We claim:

1. Building structure constructed at a remote location as a plurality of separate rectangular stationary units each having four complete exterior walls extending around the complete exterior periphery thereof a floor and a roof and transported to a building site and connected together at the building site comprising a separate stationary, but transportable prefabricated core unit having four complete exterior walls extending around the complete exterior periphery thereof, a floor and a roof and including bathroom and kitchen facilities having utilities therein and a plurality of separate entry and exit openings therein and one or more separate stationary but transportable prefabricated other building units each having four complete exterior walls extending around the complete exterior periphery thereof, a floor and a roof and including at least two entry and exit openings therein and no bathroom or kitchen facilities therein juxtaposed with the core unit with adjacent exterior walls in surface to surface contact with the entry and exit openings in the other units aligned with entry and exit openings in the core unit and connected together with the core unit at the building site to form a single building wherein the separate building units all have different roof levels to facilitate connection thereof without joining their roofs.

2. Building structure constructed as a plurality of separate stationary units at a remote location and transported to a building site and connected together at the building site comprising a separate stationary but transportable prefabricated core unit including bathroom and kitchen facilites and including a complete exterior front wall, a complete exterior back wall and complete exterior first and second end walls, said walls extending around the complete exterior of the core unit, an entry and exit opening in the front and back wall immediately adjacent the first end wall defining a hall between the front and back wall, entry and exit openings in the first end wall adjacent the front and back walls, a bathroom opening into the hall adjacent the back wall, an entry off the hall and adjacent the front wall, an eating area adjacent the second end wall and front wall, and a kitchen area adjacent the second end wall and back wall and one or more separate stationary but transportable prefabricated other building units each including separate complete exterior front, back and end walls and having at least two entry and exit openings therein and no bathroom or kitchen facilities therein juxtaposed with the core unit with adjacent exterior walls in surface to surface contact and with the entry and exit openings in the other units aligned with entry and exit openings in the core unit and connected together with the core unit at the building site to form a single building.

3. Structure as set forth in claim 2, wherein one of the other building units is a living room/bedroom unit which is substantially rectangular and includes a front and a back wall and first and second end walls defining a living and bedroom area, entry and exit openings in the front wall of the one other building unit adjacent the first end wall and adjacent the second end wall of the one other building unit in alignment with the entry and exit openings in the first end wall of the core unit.

4. Structure as set forth in claim 2, wherein one of the other building units is a living room/bedroom, bedroom unit, which is substantially rectangular and includes a front wall, a back wall and first and second end walls, a closet partition extending between the first and second end walls of the one other building unit in spaced relation to the front wall and back wall thereof dividing the one other building unit into a living room/bedroom area and a bedroom area, entry and exit openings in the second end wall of the one other building unit substantially centrally between the closet partition and back wall and between the front wall and closet partition adjacent the closet partition of the one other building unit and aligned with the entry and exit openings in the first end wall of the core unit.

5. Structure as set forth in claim 2, wherein one of the other building units includes a living room/bedroom, bedroom, bedroom unit which is substantially rectangular and includes a front wall, a back wall and first and second end walls, a first and second partition substantially parallel to the front and back walls of the one other building unit extending between the end walls in spaced apart relation to each other and the front and back walls dividing the one other building unit into a living room/bedroom, a first bedroom and second bedroom, entry and exit openings in the second end wall of the one other building unit and between the front wall and first partition adjacent the first partition and between the first and second partitions adjacent the second partition in alignment with the entry and exit openings in the first end wall of the core unit and an entry and exit opening in the second partition adjacent the second end wall of the one other building unit.

6. Structure as set forth in claim 2, wherein one of the other building units is a bedroom, bedroom unit which is substantially rectangular and includes a front and a back wall and a first and second end wall and a closet partition extending between the front and back wall in spaced relation to the first and second end walls of the one other building unit defining a first bedroom and a second bedroom and a hall partition extending between the first end wall of the one other building unit and closet partition substantially parallel to and in spaced relation to the front wall of the one other building unit defining a hall with the front wall, an entry and exit opening in the hall partition adjacent the closet partition, an entry and exit opening in the closet partition between the hall partition and the front wall of the one other building unit and an entry and exit opening in the front wall of the other building unit adjacent the first end wall thereof in alignment with the entry and exit opening in the back wall of the core unit adjacent the first end wall of the core unit.

7. Structure as set forth in claim 2, wherein the core unit includes a second entry and exit opening in the back wall thereof in the kitchen area and wherein one of the other building units is a living room/dining room unit which is substantially rectangular and includes a front and a back wall and a first and second end wall defining a living and dining area and entrance and exit openings in the front wall of the other building unit adjacent the first end wall of the other building unit and in spaced relation to but closer to the second end wall of the other building unit than to the first end wall of the other building unit which entrance and exit openings in the front wall of the one other building unit are aligned with the entrance and exit openings in the back wall of the core unit.

8. Structure as set forth in claim 2, and further including an entrance and exit opening in the other end wall of the core unit and a car port unit extending outwardly of the core unit from the second end wall of the core unit including a storage unit adjacent and extending substantially parallel to the back wall of the core unit.

9. Structure as set forth in claim 2, wherein the separate building units all have different roof levels to facilitate connection thereof without joining their roofs.

10. Building structure constructed as a plurlaity of separate stationary units at a remote location and transported to a building site and connected together at the building site comprising a separate stationary but transportable prefabricated core unit including bathroom and kitchen facilities which core unit is substantially rectangular and includes a complete exterior front wall, a complete exterior back wall, and complete exterior first and second end walls, said walls extending around the complete exterior of the core unit , an entry and exit opening in the front and back wall immediately adjacent the first end wall defining a hall between the front and back wall, entry and exit openings in the first end wall adjacent the front and back walls, a bathroom opening into the hall adjacent the back wall, an entry off the hall and adjacent the front wall, an eating area immediately adjacent the second end wall and front wall, and a kitchen area adjacent the second end wall and back wall, separate stationary but transportable prefabricated other building units each including separate complete exterior front, back and end walls extending around the complete exterior of the other building units and having no bathroom or kitchen facilities therein juxtaposed with the core unit with adjacent exterior walls in surface to surface contact and connected together with the core unit at the building site to form a single building, one of which other building units is substantially rectangular and includes a complete exterior front wall, a complete exterior back wall and complete exterior first and second end walls and at least two entry and exit openings in the second end wall of the one other building unit aligned with the entry and exit openings in the first end wall of the core unit and a second of which other building units is substantially rectangular and includes a complete exterior front wall, a complete exterior back wall and first and second complete exterior end walls and an entry and exit opening in the front wall of the second of the other building units aligned with the entrance and exit opening in the back wall of the core unit.

11. Structure as set forth in claim 10, and further including an entrance and exit opening in the back wall of the core unit in the kitchen area and an entrance and exit opening in the front wall of the second other building unit aligned with the entrance and exit opening in the back wall of the core unit in the kitchen area.

12. Structure as set forth in claim10, wherein the second other building unit includes an entry and exit opening in the first end wall adjacent the front end wall and further including a third other building unit which is substantially rectangular and includes a front and a back wall and two end walls, and an entrance and exit opening in the second end wall of the third other building unit, adjacent the front wall thereof in alignment with the entrance and exit opening in the one end wall of the second building unit.

13. Structure as set forth in claim 10, wherein the separate building units all have different roof levels to facilitate connection thereof without joining their roofs.

* * * * *

UNITED STATES PATENT AND TRADEMARK OFFICE

CERTIFICATE OF CORRECTION

PATENT NO. : 4,744,182

DATED : May 17, 1988

INVENTOR(S) : Sheldon Shacket, et al.

It is certified that error appears in the above-identified patent and that said Letters Patent is hereby corrected as shown below:

The title page showing the illustrative figure should be deleted to appear as per attached page.

Signed and Sealed this

Twentieth Day of March, 1990

*Attest:*

JEFFREY M. SAMUELS

*Attesting Officer*

*Acting Commissioner of Patents and Trademarks*

United States Patent [19]

Shacket et al.

[11] Patent Number: 4,744,182

[45] Date of Patent: May 17, 1988

[54] MODULAR BUILDING STRUCTURE AND METHOD

[75] Inventors: Sheldon Shacket, Southfield; Robert Helfman, Franklin, both of Mich.

[73] Assignee: Trus-Us, Inc., Royal Oak, Mich.

[21] Appl. No.: 470,276

[22] Filed: Feb. 28, 1983

[51] Int. Cl.[4] ..... E04H 1/00

[52] U.S. Cl. ..... 52/79.8; 52/79.1; 52/143; 52/236.4

[58] Field of Search ..... 52/79.7, 79.8, 79.1, 52/79.9, 224, 236.3, 236.4, 143, 126.1

[56] References Cited

U.S. PATENT DOCUMENTS

| | | | |
|---|---|---|---|
| 2,154,142 | 4/1939 | Whelan . | |
| 3,292,327 | 12/1966 | Van Der Lehy . | |
| 3,629,983 | 12/1971 | Jenn . | |
| 3,664,082 | 5/1972 | Zintel | 52/126.1 |
| 3,810,335 | 5/1974 | McCrillis et al. | 52/79.1 |
| 3,834,110 | 9/1974 | Vercelletto | 52/79.7 |
| 3,852,924 | 12/1974 | Levenson . | |
| 4,021,976 | 5/1977 | Colma | 52/79.7 |
| 4,102,091 | 7/1978 | Farge | 52/79.7 |
| 4,125,975 | 11/1978 | Soble | 52/126.1 |
| 4,250,669 | 2/1981 | Freeauf | 52/79.8 |

FOREIGN PATENT DOCUMENTS

| | | | |
|---|---|---|---|
| 2309960 | 3/1972 | Fed. Rep. of Germany | 52/234 |
| 2514623 | 10/1976 | Fed. Rep. of Germany | 52/126.1 |
| 1340766 | 9/1963 | France | 52/79.8 |
| 600838 | 12/1959 | Italy | 52/234 |

OTHER PUBLICATIONS

"Glider", A New Glider Caracoach for 52, 8/22/52, Two pages (2) of advertisement.

*Primary Examiner*—John E. Murtagh
*Assistant Examiner*—Andrew J. Rudy
*Attorney, Agent, or Firm*—Dale R. Small

[57] ABSTRACT

A building structure comprising a core unit including bathroom and kitchen facilities and a plurality of entrance and exit openings and a plurality of other separate building units having entrance and exit openings therein positioned adjacent the core unit and in communication therewith and with each other through aligned entrance and exit openings, separately constructed at a remote location and secured together in vertically adjusted level position at the building site. The invention further includes the method of constructing the building structure including the steps of constructing the separate core and other building units at a remote location, transporting them to a building site, locating them on foundation structures, vertically adjusting the individual structures and securing them together and subsequently adding additional other separate building units to expand the building structure.

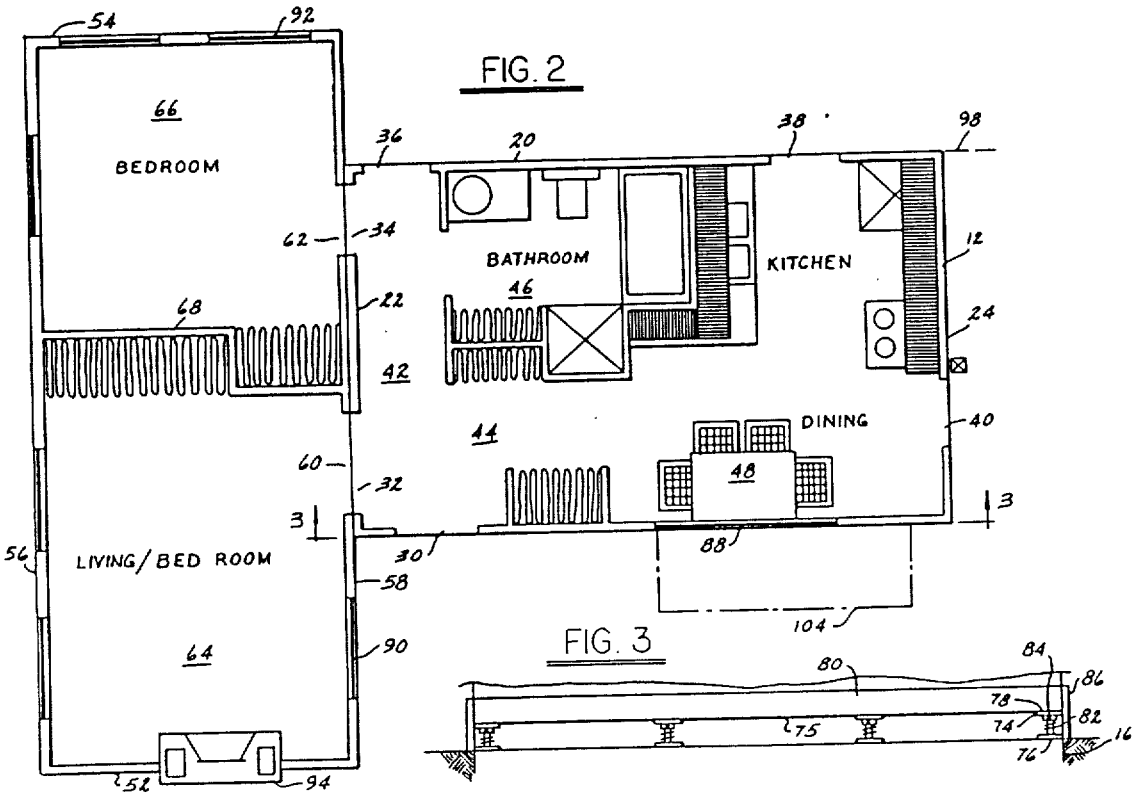

13 Claims, 5 Drawing Sheets